US005134791A

United States Patent [19]

Gregory

[11] Patent Number: 5,134,791

[45] Date of Patent: Aug. 4, 1992

[54] FOOTWEAR WITH ARCH SUPPORT

[75] Inventor: Clovis J. Gregory, Asheboro, N.C.

[73] Assignee: B. B. Walker Company, Asheboro, N.C.

[21] Appl. No.: 707,029

[22] Filed: May 29, 1991

Related U.S. Application Data

[63] Continuation of Ser. No. 505,465, Apr. 6, 1990, abandoned.

[51] Int. Cl.[5] ..... A43B 05/00; A43B 13/42

[52] U.S. Cl. ..... 36/107; 36/108; 36/113; 36/76 R; 12/142 E; 12/146 K; 12/146 BR; 12/146 S

[58] Field of Search ..... 36/113, 107, 108, 59 R, 36/59 B, 67 R, 67 B, 67 C, 76 R, 75 R, 75 A, 91, 96, 7.6, 7.7, 72 A

[56] References Cited

U.S. PATENT DOCUMENTS

| | | | |
|---|---|---|---|
| 87,722 | 3/1869 | Stewart | 36/76 R |
| 234,030 | 11/1880 | Hadley et al. | 36/108 |
| 398,453 | 2/1889 | Schnarr | 36/108 |
| 881,079 | 3/1908 | Jolitz | 36/113 |
| 1,051,880 | 2/1913 | Glenn | 36/108 |
| 1,081,057 | 12/1913 | O'Rourke | 36/108 |
| 1,152,185 | 8/1915 | Koch | 36/76 R |
| 1,653,705 | 12/1927 | Henry | 36/76 R |
| 2,045,066 | 6/1936 | Bower | 36/113 |
| 2,297,552 | 9/1942 | Hansen | 36/59 R |
| 4,170,802 | 10/1979 | Roy | 12/142 RS |
| 4,897,939 | 2/1990 | Harrington | 36/108 |
| 4,922,631 | 5/1990 | Anderie | 36/76 R |

FOREIGN PATENT DOCUMENTS

| | | | |
|---|---|---|---|
| 1130729 | 10/1968 | United Kingdom | 36/107 |

*Primary Examiner*—Steven N. Meyers

[57] ABSTRACT

Footwear with an improved arch support including an exposed gripping surface through a window in the outer sole is presented. The arch support includes a heel flange and brace which stabilizes the support between the inner and outer soles and the serrated gripping surface provides the wearer with needed traction for activities such as climbing ladders, horseback riding or the like.

6 Claims, 3 Drawing Sheets

FOOTWEAR WITH ARCH SUPPORT

This is a continuation of application Ser. No. 07/505,465 filed Apr. 6, 1990 now abandoned.

BACKGROUND OF THE INVENTION

1. Field Of The Invention

This invention pertains to outer footwear such as shoes or boots and specifically to footwear which employs a support in the arch region for providing improved reinforcement and a step gripping surface for the wearer.

2. Description Of The Prior Art And Objectives Of The Invention

For many years work shoes and boots have employed stiffeners in the arch region immediately forward of the heel to provide support to the shoe arch and to the foot. While these supports at times have proven satisfactory, at other times, under heavy load conditions or prolonged use, such past arch supports have become loose within the sole to create discomfort for the wearer. Also, prior arch supports have occasionally bent or broken when placed under extreme stress rendering them substantially useless for their intended purpose. Other prior arch supports have been satisfactory for limited, casual use conditions only to lose their support ability when subjected to adverse conditions such as when the arch is used in digging by pushing a shovel with the foot, ladder climbing, horseback riding and other direct contact activities. While the disadvantages of such prior arch supports have been known for many years, attempts at improvements have not furnished the strength and rigidity required by workers who must utilize the arch region of the footwear to perform certain tasks.

It is therefore a primary objective of the present invention to provide an improved, strengthened, rigid arch support incorporated in or useful in connection with work footwear.

Another specific objective of the present invention is to provide improved footwear which includes an arch support which is exposed in part through the bottom of the outer sole.

Another objective of the invention is to provide a method for footwear construction which incorporates an improved arch support and allows for simplicity and economy in the manufacturing process.

Yet another objective of the present invention is to provide an arch support which has a durable gripping surface to assist the wearer in activities which place the arch region of the footwear into direct contact with step surfaces such as ladders, stirrups or the like.

Various other advantages and objectives of the present invention will become apparent to those skilled in the art as a more detailed representation of the invention is presented below.

SUMMARY OF THE INVENTION

The aforesaid objectives and advantages of the present invention are realized by providing footwear such as a work shoe with an arch support formed from a rigid material such as stainless steel which is incorporated therein during the manufacturing process by inserting it between the insole and outer sole. The outer sole is formed with a "window" whereby a gripping area on the arch support is exposed along the bottom of the sole. The arch support further includes a heel flange which is perpendicularly affixed to an elongated base that stabilizes the arch support by preventing movement of it within the shoe. A triangular shaped brace is connected to the heel flange and elongated base which adds strength to the support and prevents lateral movement of the incorporated support during wear. The method of manufacturing the footwear utilizes positioning the arch support within the outer sole mold and thereafter placing a spacer between the insole and the arch support whereby the synthetic polymer used to form the outer sole will flow around and through apertures of the arch support to thereby anchor the arch support in the outer sole and heel while spacing it from the inner sole while exposing the gripping area through a window formed in the bottom of the outer sole.

DESCRIPTION OF THE PREFERRED EMBODIMENT

Figures 1, 8:
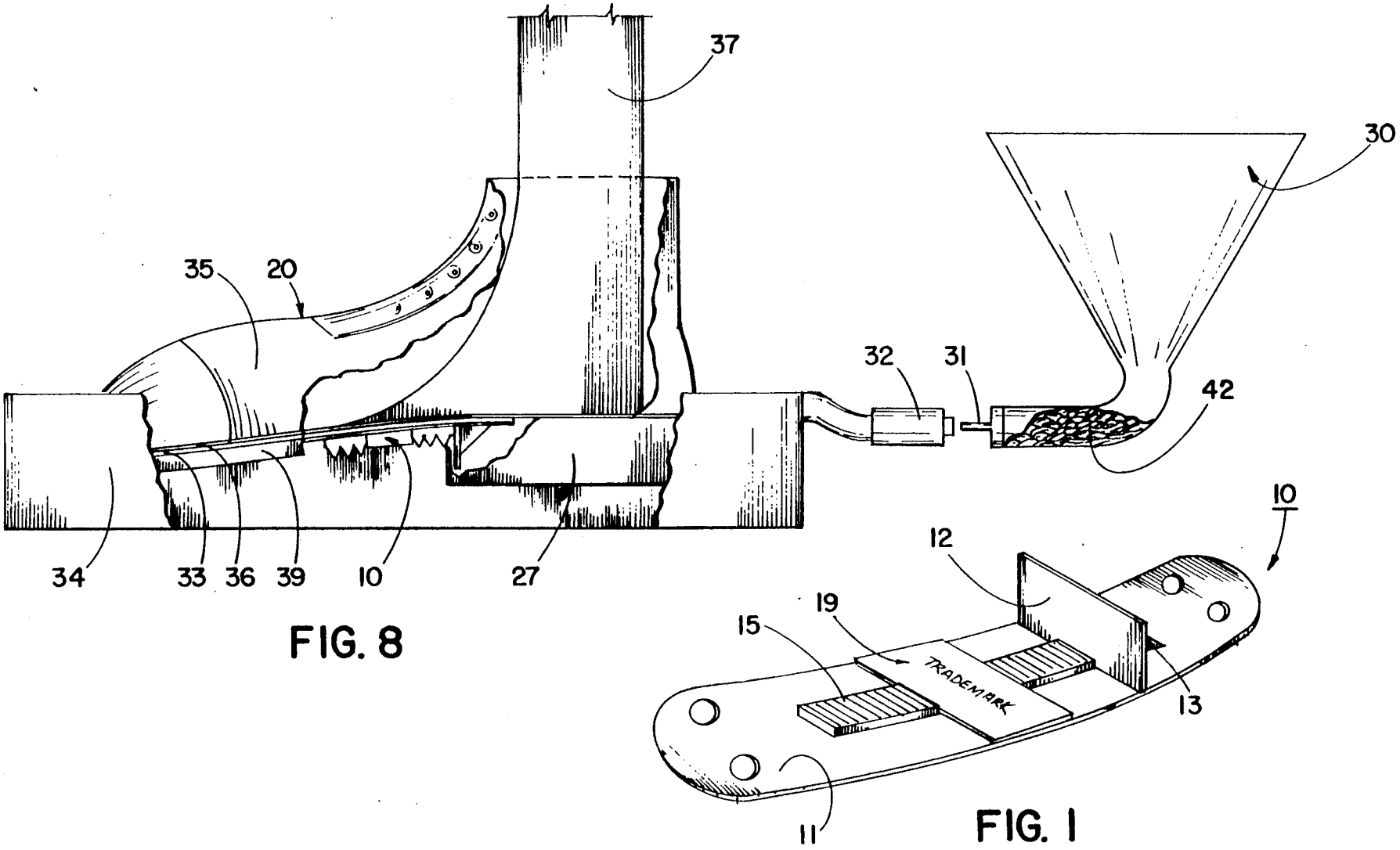
FIG. 1 illustrates in perspective fashion a view of the bottom of the arch support of the present invention.
FIG. 8 shows a schematic molding operation teaching the method of the invention.

The preferred form of the arch support of the invention is illustrated in FIGS. 1-6 formed from non-sparking stainless steel. As seen in FIG. 1, a thin elongated, slightly arcuate base member which is formed by metal casting, includes a plurality of apertures which, during sole formation provides a means to anchor the arch support securely within the footwear. The base member is slightly arcuate relative to its transverse axis, and includes thereacross a series of ridges which form a serrated gripping surface. A nameplate is mounted slightly below the gripping surface and the nameplate as shown in the embodiment in FIGS. 1-6 is smooth with recessed trademark letters. The nameplate is slightly below the top of the adjacent gripping surface to prevent excessive wear thereto. At the distal end of the serrated surface is a substantially vertical, perpendicularly positioned heel flange which is mounted and braced to the elongated base.

The preferred method of constructing the footwear of the invention comprises placing the arch support as shown in FIG. 1 against the bottom horizontal surface of an outer sole mold and thereafter setting a thermoplastic spacer, preferably formed from the same composition as the outer sole, on top of the so positioned arch support. Next, the shoe "upper", having an insole is then urged against the spacer and is temporarily affixed within the outer sole mold side walls which clamp the shoe upper in place. A thermoplastic, synthetic polymer mix of polyvinyl chloride (PVC) is then injected into the outer sole mold which, upon cooling forms the outer sole and heel of the footwear and surrounds the arch support almost entirely therein. The spacer positioned on top of the arch support somewhat liquefies during sole formation and combines with the polymer mix while maintaining the arch support in spaced relation with the insole. A window is thus formed in the bottom of the outer sole exposing the gripping area since the arch support rested against the bottom of the outer sole mold during sole formation.

DETAILED DESCRIPTION OF THE INVENTION AND METHOD OF OPERATION

Turning now to the drawings, arch support 10 as shown in FIG. 1 is integrally cast from stainless steel although other metals or rigid synthetic polymer materials (i.e., polyurethanes) woods or combinations may be used. The material selected for use is not as important as its functional characteristics as the arch support must withstand high level of stresses during use and must remain intact and be durable.

Figure 2:
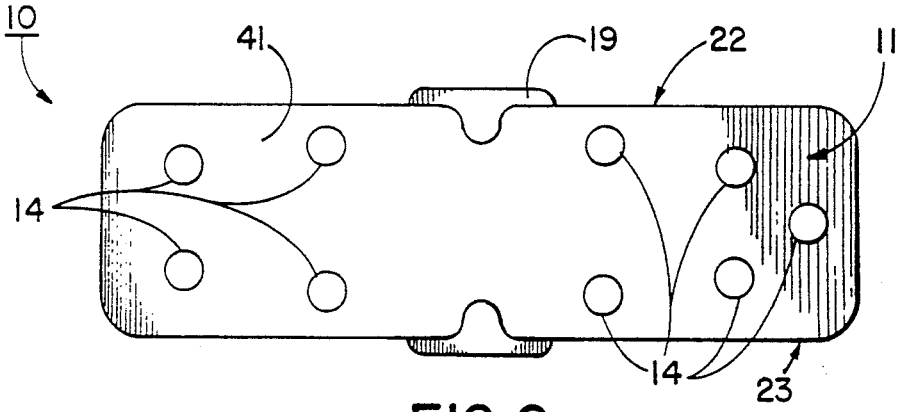
FIG. 2 is a top plan view of the arch support rotated approximately 180° from the view as shown in FIG. 1.
Figure 3:
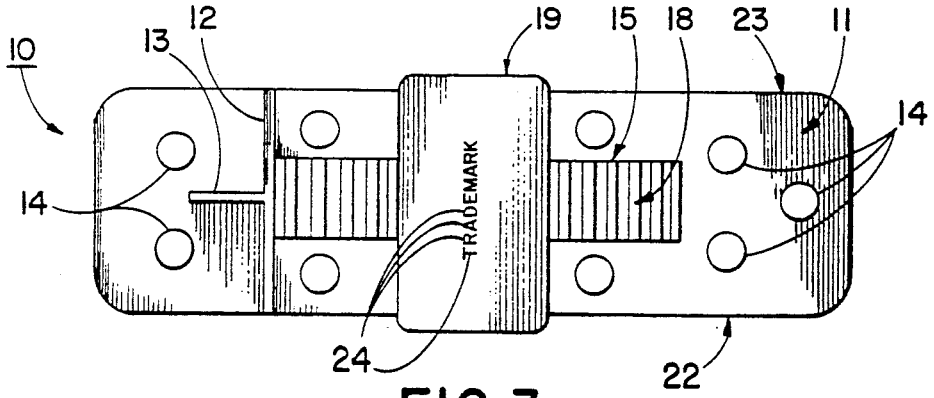
FIG. 3 demonstrates a bottom plan view of the device as seen in FIG. 2.
Figure 4:
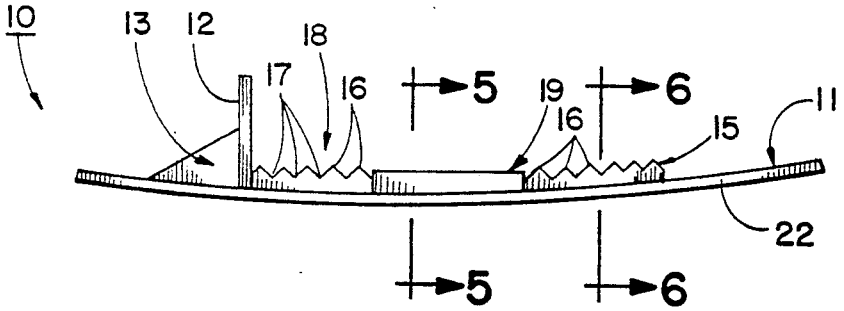
FIG. 4 depicts a side elevational view of the invention as seen in FIG. 3.
Figure 5:
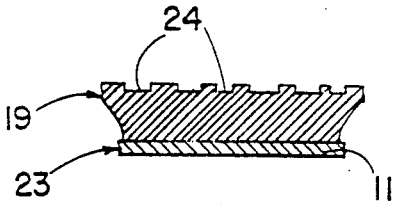
FIG. 5 provides a cross-sectional view of the arch support through lines 5—5 of FIG. 4.
Figure 6:
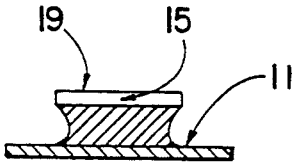
FIG. 6 pictures a cross-sectional view of arch support as shown through lines 6—6 of FIG. 4.
Figure 7:
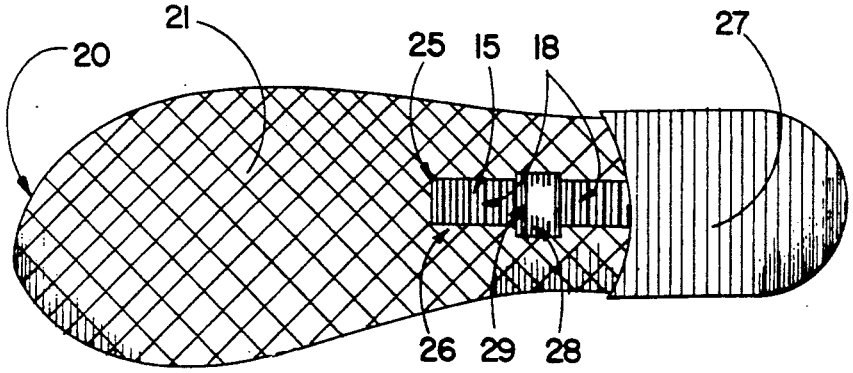
FIG. 7 exhibits a work shoe of the invention having another embodiment of the arch support exposed through the outer sole.

Arch support 10 includes a thin, slightly arcuate elongated base member 11 to which heel flange 12 is vertically affixed in substantially perpendicularly fashion. A triangular flange brace 13 as better shown in FIGS. 3 and 4 increases the rigidity of arch support 10 and prevents its lateral movement within the outer sole and heel of the footwear. A plurality of nine (9) apertures 14 are found in elongated base member 11 (FIG. 2) which provide a means to anchor arch support 10 within the footwear as the selected synthetic polymeric composition such as PVC flows into the mold and through apertures 14 to lock arch support 10 into a fixed, stable position within. A means 15 is supplied to grip a step surface such as a ladder rung, the edge of a wet step, or the like as illustrated FIGS. 1, 3 and 4. Means 15 includes a series of peaks 16 and valleys 17 which form serrated surface 18 as seen in FIG. 4. As hereinbefore explained, serrated surface 18 is exposed and is flushly positioned with the bottom outer surface of instep sole 21 of work shoe 20 as seen with arch support 25 in FIG. 7. Sole 21 may be formed from a PVC composition or other suitable materials as is heel 27. Means 15 as seen in FIG. 7 is exposed within window 26 of outer sole 21 whereby a ladder rung or other step surface can be contacted and gripped to provide traction thereagainst by the wearer. Nameplate 19 extends laterally beyond side edges 22, 23 of elongated base member 11 as shown in FIGS. 2 and 3 and may include as shown in FIG. 5 recessed trademark letters 24. In FIG. 6 the width of gripping means 15 is shown in cross-sectional view and can be compared to the width of elongated base member 11 which, as seen member 11 is somewhat wider. A second embodiment of arch support 25 is seen in FIG. 7 which includes nameplate 28 having a partially serrated surface 29 which surrounds the recessed trademark (not seen in FIG. 7). Serrated surface 29 is approximately even or level with serrated surface 18 as seen in FIG. 7, i.e., slightly above the surface of nameplate 28.

Arch support 10 is incorporated into footwear such as a work shoe 20 as seen in FIG. 8 and is securely held in place and will not break loose or provide discomfort to the wearer during adverse use conditions such as during shoveling. Work shoe 20 is generally made in a conventional manufacturing process whereby a leather upper 35 and inner sole 36 are joined during one operation and during a second operation the heel and sole are formed thereto. As seen in FIG. 8 a standard hopper 30 containing a synthetic material such as polyvinyl chloride (PVC) in pelletized form is converted into semi-liquid 42 by heat and with the addition of other desirable additives. This semi-liquid 42 is then forced through delivery tube 31 into mold inlet 32 where semi-liquid 42 fills mold cavity 33 of outer sole mold 34. Prior to the entry of semi-liquid 42, the side walls of mold 34 close to "clamp" upper shoe portion 35 which has been previously attached to inner sole 36 by sewing or the like. Press arm 37 delivers and maintains inner sole 36 within mold 34 as also shown in FIG. 8.

Figure 9:
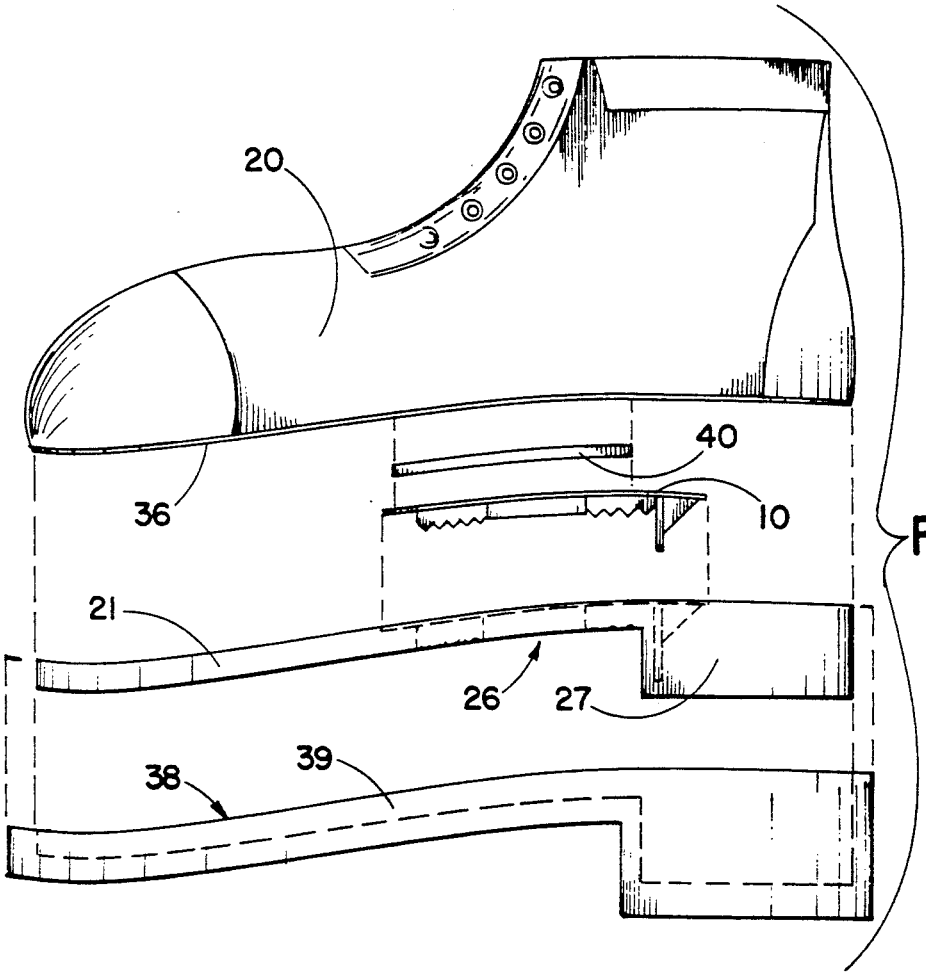
FIG. 9 presents an exploded format of the components of manufacture as shown in FIG. 8.

As explained, the steps immediately above are conventional molding techniques and are well-known within the shoe industry. The novelty of applicant's method for forming footwear with an improved arch support includes placing arch support 10 as shown in FIG. 1 against the top surface 38 of the inside of heel and sole mold 39 (FIG. 9). Once the arch support has been so positioned on surface 38, spacer 40 which may be formed from the same PVC composition within hopper 30 is set on top of upper base surface 41 of arch support 10 as shown in FIG. 2. Next, upper shoe portion 35 is lowered against spacer 40 with inner sole 36 against spacer 40. Outer sole mold 34 then clamps mold 39 together with upper shoe portion 36. The heated synthetic polymer composition 42 is then delivered under pressure into mold inlet 32 where it flows around arch support 10, through apertures 14 as shown in FIG. 2, and completely fills heel and sole mold 39. Once mold 39 has received PVC composition 42, spacer 40 softens, and somewhat liquefies due to the hot composition 42 surrounding it. Thus, the PVC composition forms outer sole 21 with window 26 as seen in FIG. 9 therein whereby gripping means 15 with nameplate 28 are exposed through the bottom of outer sole 21 as viewed in FIG. 7.

While a conventional PVC composition is used herein for forming the preferred embodiment of the footwear sole, likewise footwear could also be manufactured employing conventional soles such as leather or rubber. In such cases, soles could be cut or notched after manufacture to form the required window to receive gripping means 15 and likewise, a conventional leather heel could be drilled or routed to accept heel flange 12 as seen in FIG. 1. Thus, while conventional molding techniques can be employed in conveniently forming the improved footwear, various other methods could be used to provide common heels and soles on usual footwear with improved arch support 10. In addition, although work shoes and boots may have the greatest need for arch support 10 as described herein, western boots, military boots and shoes, standard leisure shoes and other types may also be desirable candidates for arch support 10. Also women, children, production workers, farmers and other persons who may even ocassionally perform manual labor requiring the legs or feet will benefit from the invention herein including those that must climb telephone poles, light poles or similar structures having small step surfaces.

As stated above, stainless steel is the preferred material of arch support 10 since it is non-sparking in nature it can safely be used around volatile substances and other dangerous or combustionable chemicals, although a rigid polyurethane or other synthetic polymer may be employed without sacrificing strength or the required rigidity.

The illustrations and examples provided herein are for explanatory purposes and are not intended to limit the scope of the appended claims.

I claim:

1. Footwear having an insole and an outer sole in combination with an arch support disposed therebetween, said outer sole having an exposed bottom surface, said arch support comprising: an elongated base, means to grip a step surface, said gripping means affixed to said base, said outer sole defining an arch window with said outer sole substantially surrounding said window, said gripping means positioned within said window coextensively with said bottom surface of said surrounding outer sole, said gripping means comprising a pair of serrated surfaces, having downwardly extending peaks, whereby said serrated surfaces are exposed through said arch window and the downwardly extending peaks extend so as to be flush with the exposed bottom surface of the outsole, and wherein the arch support further comprises a planar non-serrated surface positioned between said serrated surfaces.

2. Footwear as claimed in claim 1 wherein said elongated base is slightly arcuate.

3. Footwear as claimed in claim 1 wherein said arch support includes a heel flange, said flange connected to said elongated base.

4. Footwear as claimed in claim 1 wherein said arch support is formed from stainless steel.

5. Footwear as claimed in claim 1 wherein said arch support is formed from a synthetic polymer.

6. The footwear combination as claimed in claim 1 wherein said outer sole is formed from polyvinyl chloride and said arch support is formed from stainless steel.

* * * * *